US006705857B2

(12) United States Patent
Paschereit et al.

(10) Patent No.: US 6,705,857 B2
(45) Date of Patent: Mar. 16, 2004

(54) METHOD FOR INJECTING FUEL INTO A BURNER

(75) Inventors: Christian Oliver Paschereit, Baden (CH); Peter Flohr, Baden (CH)

(73) Assignee: Alstom Technology Ltd., Baden (CH)

( * ) Notice: Subject to any disclaimer, the term of this patent is extended or adjusted under 35 U.S.C. 154(b) by 121 days.

(21) Appl. No.: 09/984,613

(22) Filed: Oct. 30, 2001

(65) Prior Publication Data

US 2002/0177093 A1 Nov. 28, 2002

(30) Foreign Application Priority Data

Nov. 9, 2000 (DE) ..... 100 55 408

(51) Int. Cl.[7] ..... F23D 14/58

(52) U.S. Cl. ..... 431/350; 431/8; 431/114; 431/174

(58) Field of Search ..... 431/350, 353, 431/8, 9, 114, 10, 173, 174, 177, 351; 60/737, 746, 725

(56) References Cited

U.S. PATENT DOCUMENTS

| | | | | | |
|---|---|---|---|---|---|
| 5,375,995 | A | * | 12/1994 | Dobbeling et al. | 431/8 |
| 5,482,457 | A | * | 1/1996 | Aigner et al. | 431/351 |
| 5,943,866 | A | * | 8/1999 | Lovett et al. | 431/114 |
| 6,360,776 | B1 | * | 3/2002 | McCormick et al. | 60/737 |

FOREIGN PATENT DOCUMENTS

| | | | | | |
|---|---|---|---|---|---|
| DE | 4336096 | A1 | | 5/1994 | |
| DE | 4440558 | A1 | | 5/1996 | |
| DE | 4441235 | A1 | | 5/1996 | |
| DE | 4441641 | A1 | | 5/1996 | |
| DE | 4446945 | A1 | | 7/1996 | |
| DE | 19809364 | A1 | | 9/1998 | |
| DE | 199 48 673 | A1 | * | 4/2001 | F23D/14/62 |
| DE | 19948674 | A1 | | 4/2001 | |
| EP | 0321809 | B1 | | 5/1991 | |
| EP | 0592717 | A1 | | 4/1994 | |
| EP | 0918152 | A1 | | 5/1999 | |
| EP | 1001214 | A1 | | 5/2000 | |
| JP | 2000-88251 | A | * | 3/2000 | F23R/3/30 |
| WO | WO 02/052201 | A1 | * | 7/2002 | F23R/3/28 |

OTHER PUBLICATIONS

Paschereit et al., "Structure and Control of Thermoacoustic Instabilities in a Gas–turbine Combustor", Science & Technology, vol. 138, 213–232, 1998, Overseas Publishers Association, Malaysia.

* cited by examiner

*Primary Examiner*—Josiah Cocks
(74) *Attorney, Agent, or Firm*—Burns, Doane, Swecker & Mathis, L.L.P.

(57) ABSTRACT

In a method for injecting fuel into a burner (1), which burner (1) comprises an inner chamber (22) enclosed by at least one shell (8, 9), at which inner chamber fuel is injected through fuel nozzles (6) into a combustion air stream (23) flowing inside the inner chamber (22), the resulting fuel/air mixture flows within a time-lag ($\tau$) to a flame front (3) in a combustion chamber (2), and is ignited there, the formation of thermoacoustic, ignition-driven vibrations is achieved in that the fuel is injected in such a way by means of fuel nozzles (6) distributed over the burner length that the time-lag ($\tau$) between the injection of the fuel and its combustion at the flame front (3) corresponds to a distribution (12) that varies systematically over the burner length for the various fuel nozzles and reduces the vibrations.

9 Claims, 6 Drawing Sheets

METHOD FOR INJECTING FUEL INTO A BURNER

FIELD OF THE INVENTION

The present invention concerns a method for injecting fuel into a burner, for example into a double cone burner, as well as a burner for performing this method.

BACKGROUND OF THE INVENTION

Frequently, so-called thermoacoustic fluctuations occur in burners that supply liquid or gaseous fuel to a combustion chamber where the fuel burns on a flame front. This is also the case, for example, with the very successfully used, so-called double-cone burner as described in EP 0 321 809. In addition to fluidic stability, mixture break fluctuations are a main reason for the occurrence of such thermoacoustic instabilities. Fluid-mechanical instability waves generated at the burner result in a formation of whirls (coherent structures) that influence the combustion and may lead to a period heat release and pressure fluctuations associated with it. The fluctuating air column in the burner results in fluctuations in the mixture break with the respective associated fluctuations in the heat release.

These thermoacoustic vibrations present a risk for any type of combustion application. They result in high-amplitude pressure vibrations, a limitation of the operating range, and may increase noxious emissions. This is true in particular for combustion systems with low acoustical attenuation. In order to permit a high performance conversion over a broad operating range with respect to pulsations and emissions, an active control of the combustions vibrations may be necessary.

Coherent structures play a critical role in the mixing processes between air and fuel. The dynamics of these structures therefore influence the combustion and therefore the heat release. A control of the combustion instabilities is made possible by influencing the shear layer between the fresh gas mixture and recirculated waste gas (for example, Paschereit et al., 1998, "Structure and Control of Thermoacoustic Instabilities in a Gas-turbine Burner", Combustion, Science & Technology, Vol. 138, 213–232). One possibility for doing this is acoustic excitation (EP 0 918 152 A1).

The flame position can be changed by fuel staging, and the influence of flow instabilities as well as of time-lag effects can be reduced.

A further mechanism that may result in thermoacoustic vibrations are fluctuations in the mixture break between fuel and air.

SUMMARY OF THE INVENTION

The invention therefore has the objective of disclosing a burner for performing such a method in which the occurrence of such thermoacoustic vibrations is reduced or even avoided.

This concerns a method for injecting fuel into a burner comprising an inner chamber enclosed by at least one shell, at which inner chamber fuel is injected through fuel nozzles into a combustion air stream flowing inside the inner chamber, the resulting fuel/air mixture flows within a time-lag $\tau$ to a flame front in a combustion chamber, and is ignited there.

According to the invention, thermoacoustic fluctuations are reduced or even avoided altogether with such a method in that the fuel is injected by means of fuel nozzles distributed over the burner length in such a manner that the time-lag $\tau$ between the injection of the fuel and its combustion at the flame front corresponds to a distribution that varies systematically for the various fuel nozzles and prevents ignition-driven vibrations.

According to experience, in a conventional burner the time-lag $\tau$ between the injection site and the effective combustion at the flame front is essentially identical for all of the burner nozzles distributed over the burner length. An unsystematic, slight variation from the injection position around a mean value is found. As a result, it is easy for thermoacoustic vibrations to form. The core of the invention therefore consists of injecting the fuel into the combustion air stream in such a way that no time-lag $\tau$ between the injection site and the effective combustion at the flame front—a time-lag that is essentially identical for all fuel nozzles distributed over the burner length—occurs, but that the time-lag assumes a distribution that systematically varies over the burner length.

A first preferred embodiment of the invention is characterized in that the maximum time-lag $\tau_{max}$ between injection site and flame front is in the range of $\tau_{max}$=5–50 ms, and that, especially preferred, with a flow speed of the fuel/air mixture in the inner chamber in the range from 20–50 m/s, the maximum time-lag $\tau_{max}$ is in the range of $\tau_{max}$=5–15 ms, and this with consideration of the shifting of the flame front position in relation to the flow speed. If the method is used under such conditions, thermoacoustic vibrations can be reduced especially well.

In another embodiment of the invention, the fuel is injected in such a manner that the time-lag distribution over the burner length towards the burner end is designed so as to essentially decrease in a linear manner from the maximum value $\tau_{max}$ by a maximum time-lag differential $\Delta\tau$ towards a minimum value at the burner end of $\tau_{max}-\Delta\tau$. This simple distribution can be realized with relatively little expenditure and has an efficient effect. It is found that the time-lag differential $\Delta\tau$ is preferably set in the range from 10–90% of the maximum value $\Delta_{max}$, especially in the range above 50% of the maximum value $\tau_{max}$.

The burner in another embodiment of the method is a double cone burner, in which the burner is made up of at least two superimposed hollow partial cone bodies that are provided in the flow direction with an increasing cone angle, and which partial cone bodies are arranged offset in relation to each other so that the combustion air flows through a gap between the partial cone bodies into the inner chamber. The method can be used especially advantageously in this already mentioned, premix-like double cone burner.

The invention furthermore concerns a burner for performing the above method, whereby the fuel nozzles are divided into groups, and whereby in each case one group of fuel nozzles are arranged on a line in such a manner that all fuel nozzles of a group are responsible for feeding the same area in the flame front. It is especially preferred that with such a burner the fuel nozzles are distributed in such a manner that the number of lines is greater than the average number of fuel nozzles of a group. For example, in a double cone burner the fuel nozzles on the cone surfaces of the partial cone bodies can be arranged on lines for an area of the flame front. It is hereby found that a division of the overall 32 nozzles of a double cone burner into 8 groups on 8 lines with 4 each nozzles is advantageous.

BRIEF DESCRIPTION OF THE DRAWINGS

The invention is explained below with the help of embodiments in reference to the drawings. Hereby.

DETAILED DESCRIPTION OF THE INVENTION

Figure 1A:
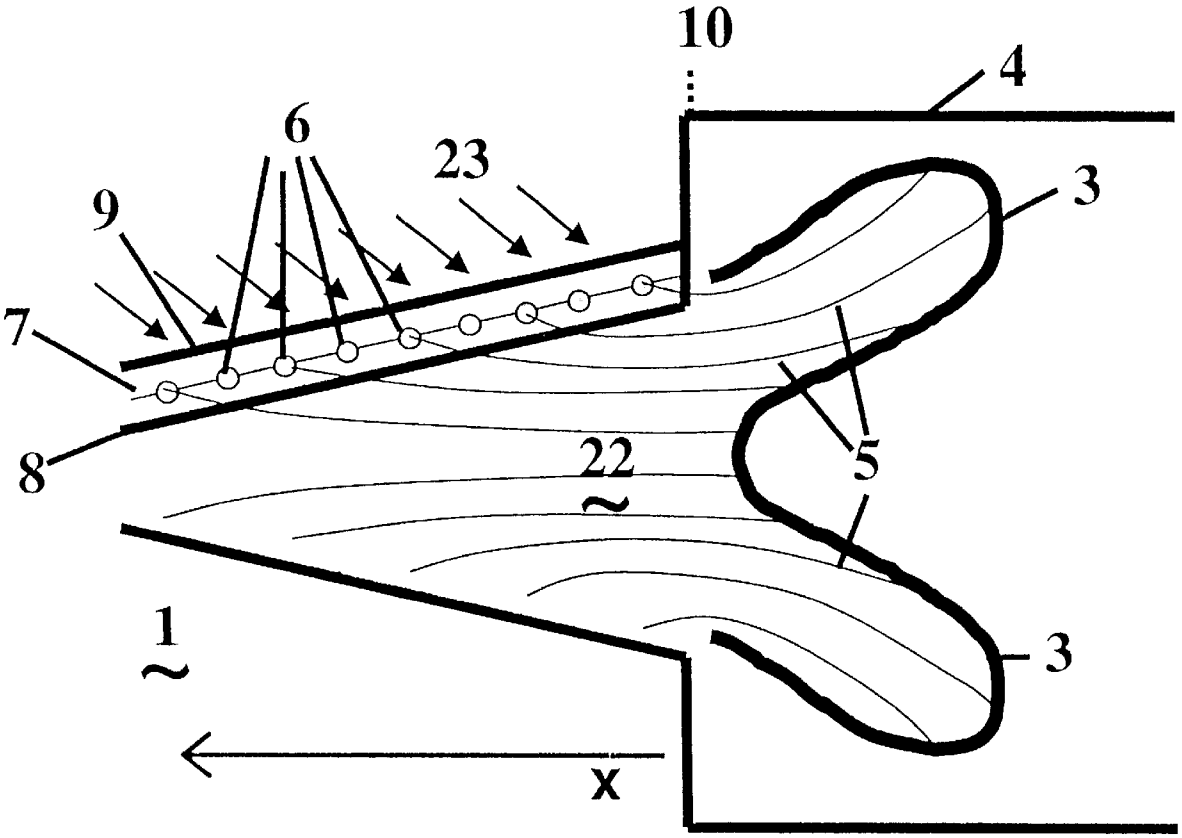
Fig. 1a) PRIOR ART
FIG. 1*a*) shows a conventional double cone burner with typical fuel injection.

The combustion instabilities can be controlled by influencing the time-lag between the fuel injection and the periodic heat release, i.e., the flame front. The basic idea of the invention is to interfere with the time-lag $\tau$ between the periodic heat release at the flame front and the pressure fluctuation at the injection, so that the Rayleigh criterion $$G(x) = \frac{1}{T}\int_0^T p'(x,t)q'(x,t)\,dt < 0$$

is no longer fulfilled, i.e., the heat release and pressure maximum are no longer in phase. This prevents the driving mechanism for the occurrence of thermoacoustic vibrations. The illustration of the Rayleigh criterion following Fourier transformation in the frequency range shows this connection even more clearly:

$$G(x)=2\int|S_{pq}(x,f)|\cos(\phi_{pq})df$$

whereby $S_{pq}$ presents the cross spectrum between pressure fluctuations p' and fluctuations of the heat release q', and $\phi_{pq}$ presents the phase differential. By choosing the correct phase differential between the heat release (can be influenced by the time-lag) and the pressure signal, the Rayleigh index can be adjusted to $G(x)<0$, i.e., the system is attenuated. It was now found that the time-lag in existing premix burners is constant from the injection site at the fuel nozzles to the flame front over the entire injection length of the premix gas at specific operating points. This is, for example, the case for a double cone burner according to the state of the art as shown in FIG. 1*a*).

In this longitudinal section through a double cone burner 1, which should be understood as an example, as known, for example, from EP 0 321 809, the top gap 7 can be seen between the two conical burner shells 8 and 9. The combustion air 23 enters through this gap 7, passing the fuel nozzles 6 distributed over the burner length, into the inner chamber 22, whereby the fuel is entrapped and enclosed by the air 23 that flows by. Inside the inner chamber 22 of the burner 1, the combustion air stream flows along the flow lines 5 under formation of a conical fuel column spreading in the flow direction. The fuel/air mixture then reaches the combustion chamber 2, where it is ignited at a flame front 3.

Figure 1B:
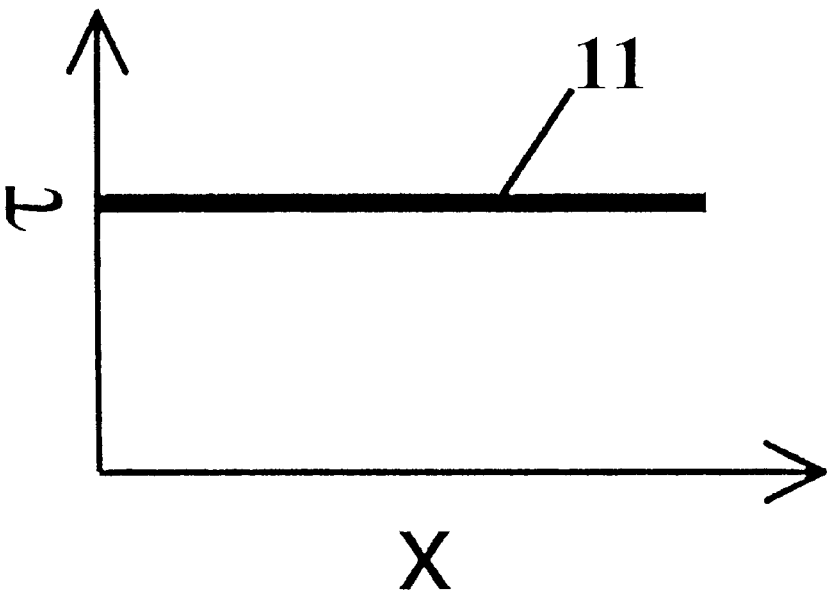
Fig. 1b) PRIOR ART
FIG. 1*b*) shows the schematic time-lag distribution over the burner length that occurs in a burner according to FIG. 1*a*)

In such a double cone burner, the time-lag $\tau$ that passes between the injection at the fuel nozzles 6 and the ignition at the flame front 3 is almost constant for all positions of the fuel nozzles, as shown schematically in FIG. 1*b*) (the x coordinate hereby extends from the outlet 10 of the burner 1 to its back end, i.e., in FIG. 1*a*) from right to left). In other words, no systematic variation of the time-lags $\tau$ as a function of the fuel nozzle position along the burner 1 can be observed (for example, shorter time-lags for nozzles 6 that are close to the burner outlet 10), but rather a more or less random appearing distribution of the function with only little fluctuation from a mean value as a function of the injection site x.

Figure 2:
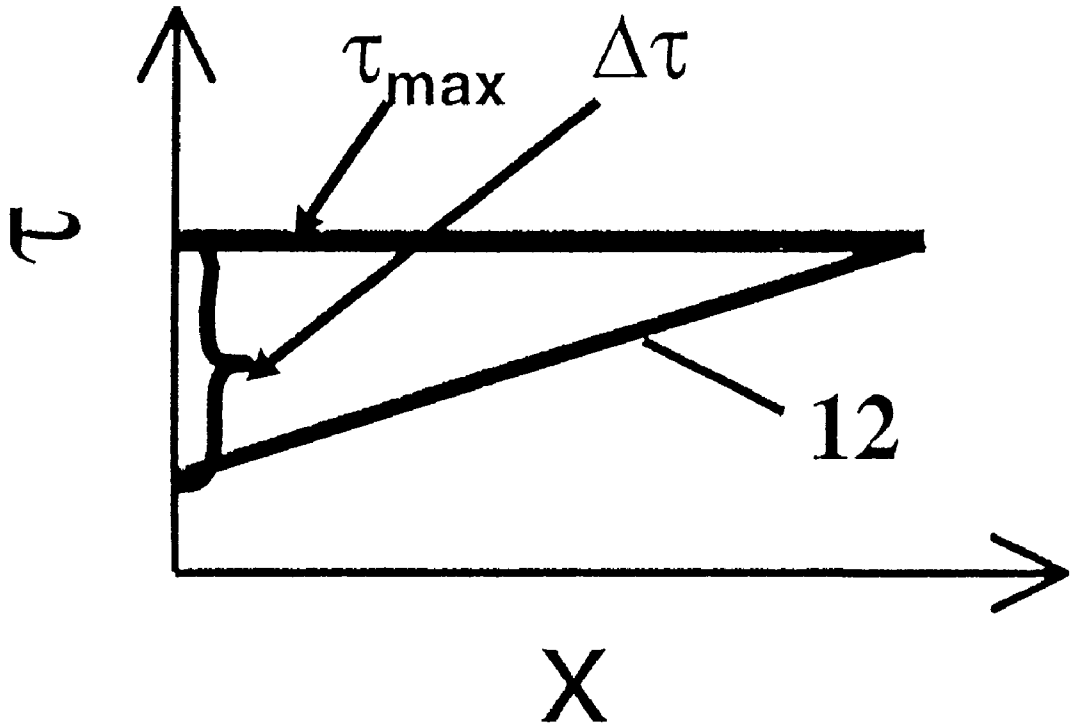
FIG. 2 shows a linear time-lag distribution.

As shown in FIG. 2, it is now suggested according to the invention that instead of the formerly essentially constant time-lag from the fuel injection 6 to the flame front 3, a distribution of the time-lag over the burner length is set. In a first selection, the distribution is adjusted so that the time-lags $\tau$ are varied in a linear manner by a time-lag differential $\Delta\tau$, i.e., with a linear increase from a minimum $\tau_{max}-\Delta\tau$ to the maximum in the rear burner area of $\tau_{max}$.

Figure 3:
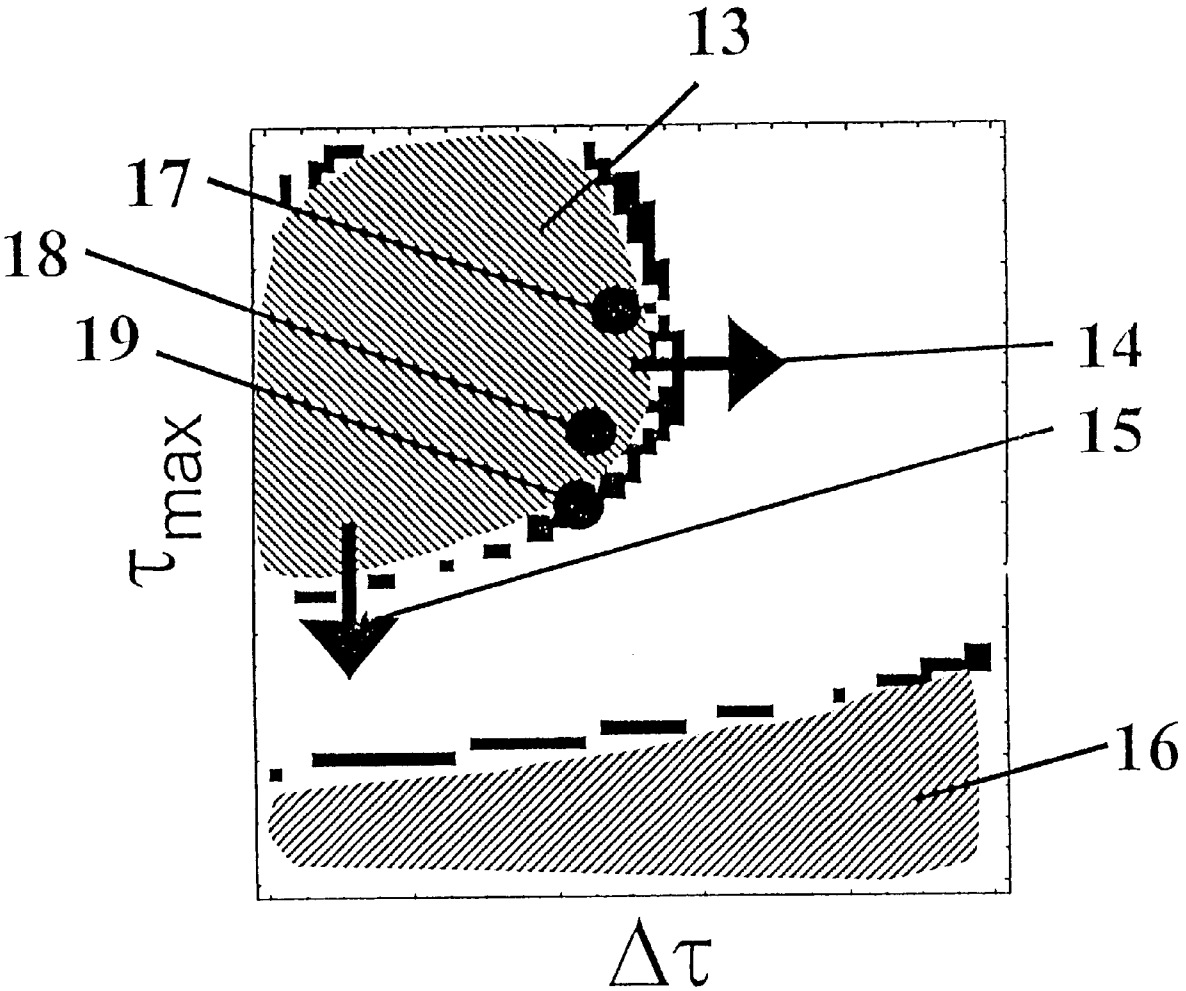
FIG. 3 shows a two-dimensional stability analysis of time-lag distributions.

In a two-dimensional illustration, FIG. 3 shows the burner stability as a function of the parameters $\Delta\tau$ (x-axis) and $\tau_{max}$ (y-axis) for a time-lag distribution as shown in FIG. 2. Individual measuring values given are hereby, as examples, three values for the behavior at different flow speeds in the burner: for a low flow speed 17, for a medium flow speed 18, and for a high flow speed 19. In general, it is found that two basically unstable areas form (here shown striated). On the one side is an unstable area 16 with short time-lags. Almost independent from the selection of $\Delta\tau$, the burner is not acoustically stable here for such high flow speeds. A second, island-like area 13 with unstable behavior is found for low speeds, i.e., high values of $\tau_{max}$ and for low values of $\Delta\tau$.

It can now be seen clearly that the stability of a burner that operates with its typical operating values in most cases close to the island 13 can be stabilized by an increase of the flow speed according to arrow 15, as well as by an increase of the time-lag differential $\Delta\tau$, i.e., by shifting of the operating point in the graphic to the right, according to the arrow 14. Since for practical reasons the value of $\tau_{max}$ cannot always be shifted into the stable lower range according to 15, a shifting by setting higher time-lags differential $\Delta\tau$, i.e., via broader spread time-lags, is often an efficient and feasible alternative.

Typically, the time-lags for burners are in the range of $\tau$=5–50 ms, for double cone burners normally in the range from 5–15 ms at flow speeds of 10–50 m/s. $\Delta\tau$ now can be varied within a broad range, but typically variations of $\Delta\tau=0.5\,\tau_{max}$ are used; for double cone burners, a variation of $\Delta\tau\geqq 0.5\,\tau_{max}$ was found to be especially advantageous.

Such a distribution can be technically realized in an exemplary embodiment of a double cone burner as shown already in FIG. 1, by way of a simple modification of the fuel injection into the combustion air stream 23. The fuel nozzles 6 here are not arranged directly at the gap 7 between the two shells 8 and 9, but are set onto or respectively into the cone surfaces of elements 8 and 9, so that the time-lags are systematically set. For this purpose, the fuel nozzles 6 can be divided into groups, and the nozzle groups of a group each are hereby arranged on lines 20 that follow the flow lines along the burner contour. Nozzles of one group feed a specific region of the flame front, but with a different time-lag $\tau$ between the moment of injection and the arrival at the flow front 3. It is hereby of advantage to form as many small groups as possible in order to create an evenly distributed flame additionally to the spreading of the time-lag. A number of 32 nozzles, which is typical for double cone burners because of the drop in pressure, a division into 8 groups, whose 4 each nozzles (two per cone 8 or respectively 9) are arranged on 8 lines with identical time-lag, are suitable to prevent the thermoacoustic vibrations.

Figure 4A:
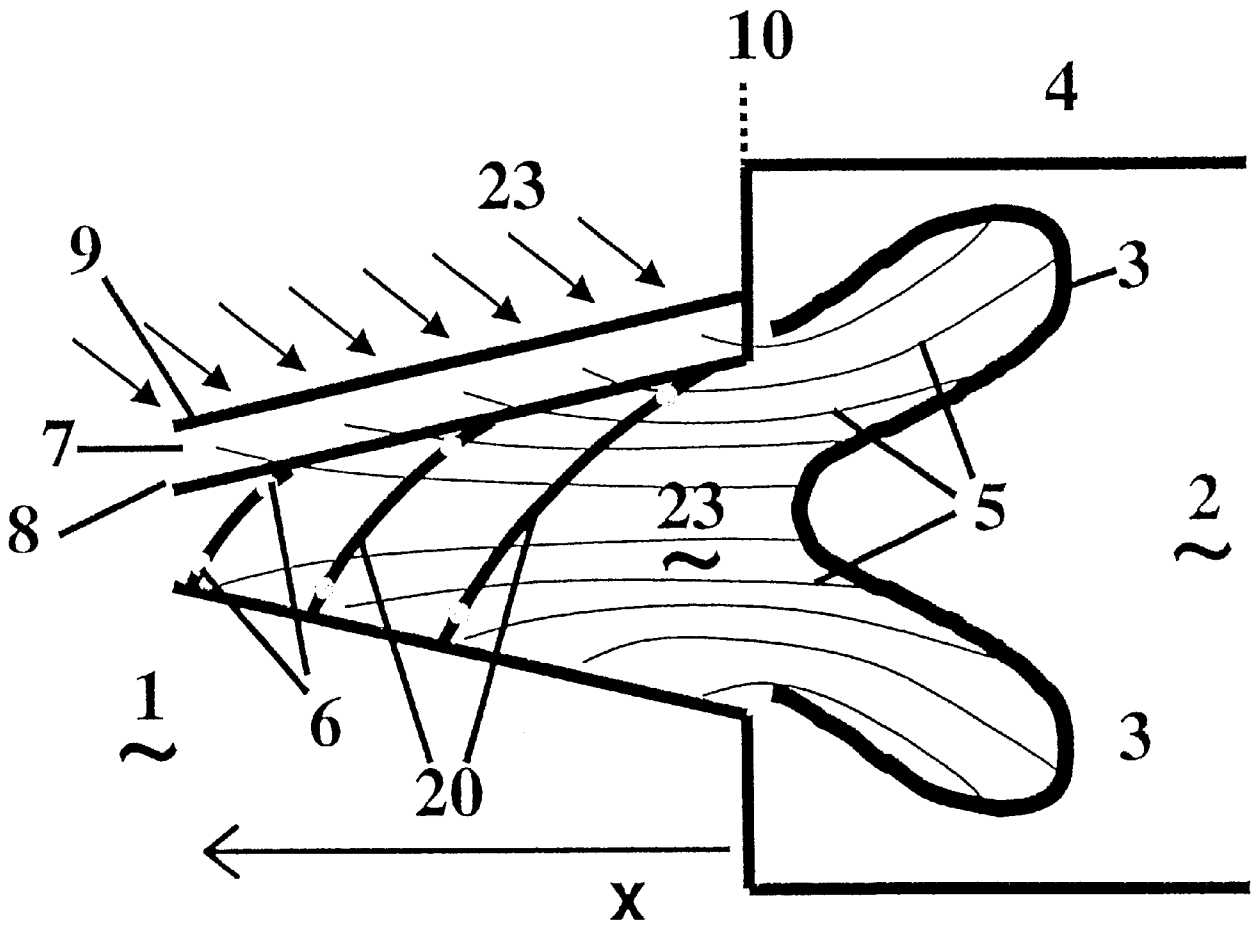
FIG. 4*a*) shows a double cone burner with distributed fuel nozzle arrangement.
Figure 4B:
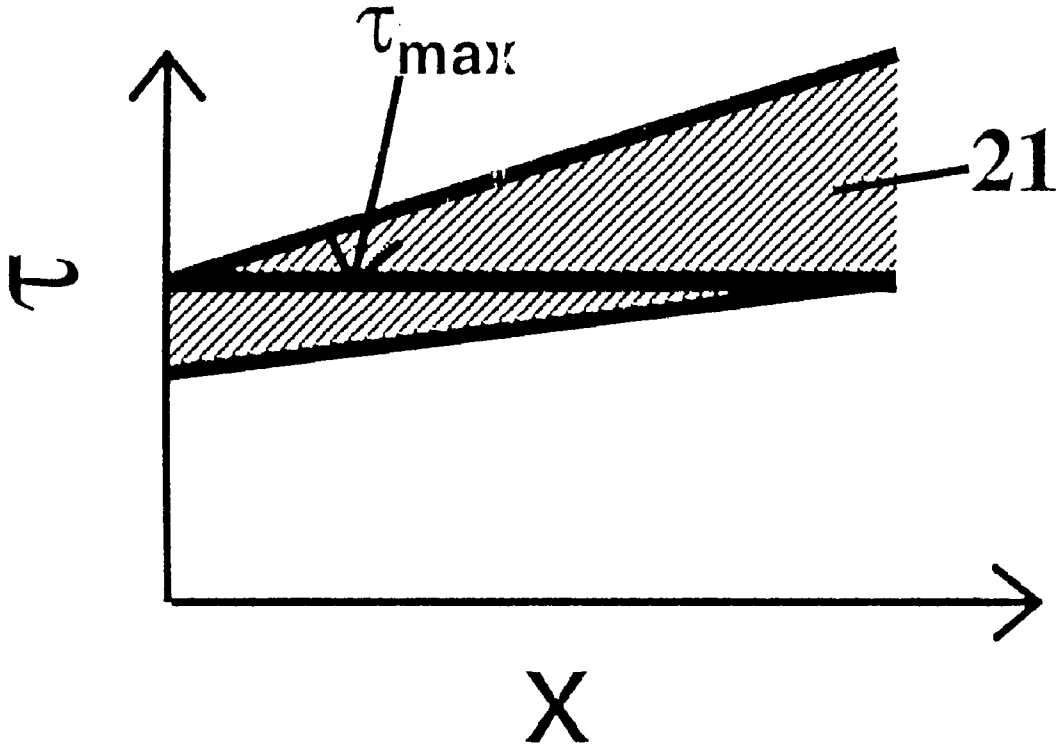
FIG. 4*b*) shows potential time-lag distributions in a burner according to FIG. 4*a*).

An arrangement of the fuel nozzles 6 on such lines 20 now permits the adjustment of time-lags distributions in an overall range 21 as shown in FIG. 4*b*).

Naturally, other arrangements of the fuel nozzles at or, respectively, in a burner that result in a systematic distribution of the time-lags that specifically prevent thermoacoustic vibrations, are possible. Both the presented exemplary embodiment as well as the specified, essentially linear distributions should only be understood as examples.

| List of Reference Numbers | |
|---|---|
| 1 | Double cone burner |
| 2 | Combustion chamber |
| 3 | Flame front |
| 4 | Wall of combustion chamber |
| 5 | Flow lines of fuel/air mixture |
| 6 | Fuel nozzles |
| 7 | Gap between conical shells of the burner |
| 8 | Inner conical shell of the burner at 7 |
| 9 | Outer conical shell of the burner at 7 |
| 10 | Front end of double cone burner |
| 11 | Constant time-lag |
| 12 | Distribution of time-lags |
| 13 | Unstable region of long time-lags |
| 14 | Stabilizing shift towards wide distributions of time-lags |
| 15 | Stabilizing shift towards short time-lags |
| 16 | Unstable region of short time-lags |
| 17 | Behavior for slow flow |
| 18 | Behavior for medium flow |
| 19 | Behavior for fast flow |
| 20 | Lines for same region of the flame front |
| 21 | Adjustable range of time-lags |
| 22 | Inner chamber |
| 23 | Flow of combustion air |

What is claimed is:

1. Method for injecting fuel into a burner, which burner comprises an inner chamber enclosed by at least one shell, at which inner chamber fuel is injected by way of fuel nozzles into a combustion air stream flowing inside the inner chamber, the resulting fuel/air mixture flows within a time-lag ($\tau$) to a flame front in a combustion chamber, and is ignited there, wherein the burner is a double cone burner, in which the burner is made up of at least two superimposed, hollow partial cone bodies that are provided in the flow direction with an increasing cone angle, and which partial cone bodies are arranged offset in relation to each other so that the combustion air flows through a gap between the partial cone bodies into the inner chamber, and wherein the fuel is injected in such a way by means of fuel nozzles distributed along lines which follow streamlines along a contour of the burner over the burner length in such a way that the time-lag ($\tau$) between the injection of the fuel and its combustion at the flame front for the various fuel nozzles corresponds to a distribution that varies systematically over the burner length and avoids ignition-driven fluctuations.

2. Method as claimed in claim 1, wherein the maximum time-lag ($\tau_{max}$) between injection site and flame front is in the range of $\tau_{max}$=5–50 ms.

3. Method as claimed in claim 2, wherein at a flow speed of the fuel/air mixture in the inner chamber in the range of 20–50 m/s, the maximum time-lag ($\tau_{max}$) is in the range of $\tau_{max}$=5–15 ms.

4. Method as claimed in claim 1, wherein the fuel is injected in such a way that the time-lag distribution over the burner length towards the burner end is designed so as to decrease in an essentially linear manner from the maximum value $\tau_{max}$ by a maximum time-lag differential ($\Delta\tau$) to a minimum value at the burner end of $\tau_{max}$ $\Delta\tau$.

5. Method as claimed in claim 4, wherein the time-lag differential ($\Delta\tau$) is in the range of 10–90% of the maximum value ($\tau_{max}$).

6. Method as claimed in claim 5, wherein the time-lag differential ($\Delta\tau$) is in the range above 50% of the maximum value ($\tau_{max}$).

7. Burner for performing a method as claimed in claim 1, wherein the fuel nozzles on cone surfaces of the partial cone bodies are arranged on lines which follow the streamlines along the burner contour and which feed a specific region of the flame front, and wherein the fuel nozzles are divided into groups, whereby in each case one group of fuel nozzles is arranged in such a way on a line that all nozzles of the group feed a specific region of the flame front with a different time-lag ($\tau$).

8. Burner as claimed in claim 7, wherein the number of lines is greater than the average number of fuel nozzles of a group.

9. Burner as claimed in claim 7, wherein the burner has a total of 32 nozzles that are divided into 8 groups on 8 lines with 4 nozzles each.

* * * * *